US011655575B2

(12) United States Patent
Fujihara

(10) Patent No.: US 11,655,575 B2
(45) Date of Patent: May 23, 2023

(54) EMBROIDERY FRAME, METHOD FOR CAUSING SEWING OBJECT TO BE HELD ON EMBROIDERY FRAME, AND INNER FRAME OF EMBROIDERY FRAME

(71) Applicant: BROTHER KOGYO KABUSHIKI KAISHA, Nagoya (JP)

(72) Inventor: Shinya Fujihara, Obu (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 80 days.

(21) Appl. No.: 17/189,848

(22) Filed: Mar. 2, 2021

(65) Prior Publication Data

US 2021/0301442 A1 Sep. 30, 2021

(30) Foreign Application Priority Data

Mar. 27, 2020 (JP) ..... JP2020-057178

(51) Int. Cl.
*D05C 9/04* (2006.01)

(52) U.S. Cl.
CPC ..... *D05C 9/04* (2013.01)

(58) Field of Classification Search
CPC ... D05C 9/04; D05C 9/10; D05C 1/02; D05C 1/04; D05B 39/00
See application file for complete search history.

(56) References Cited

U.S. PATENT DOCUMENTS

2005/0229830 A1 10/2005 Hori
2017/0173996 A1* 6/2017 Lu ..... A47G 1/06

FOREIGN PATENT DOCUMENTS

JP 2002-136785 A 5/2002
JP 2005-279011 A 10/2005
JP 2006280900 A * 10/2006

* cited by examiner

*Primary Examiner* — Alissa L Hoey
*Assistant Examiner* — Patrick J. Lynch
(74) *Attorney, Agent, or Firm* — Oliff PLC

(57) ABSTRACT

An embroidery frame includes a frame-shaped outer frame and an inner frame configured to hold a sewing object together with the outer frame. The inner frame includes a first member provided with a restriction portion, and a second member configured to be rotatably supported around a rotating shaft between a first position and a second position with respect to the first member. The second position is a position at which an angle of the second member with respect to the first member is a contact angle. The second member includes a contact portion. A first distance between a first end portion and a second end portion when the second member is in the first position is longer than a second distance between the first end portion and the second end portion when the second member is in the second position.

16 Claims, 10 Drawing Sheets

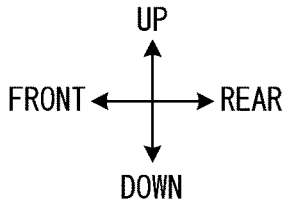
FIG. 6A
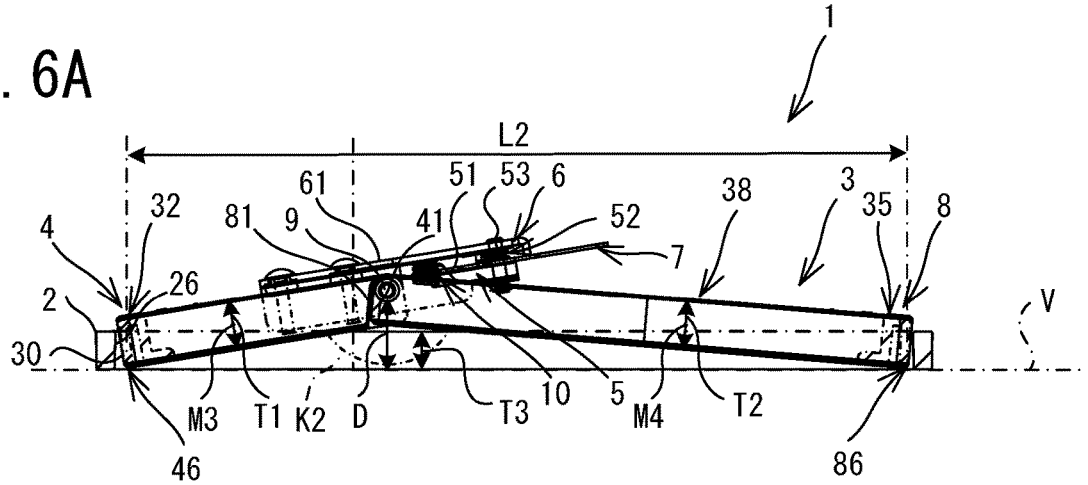
FIG. 6B
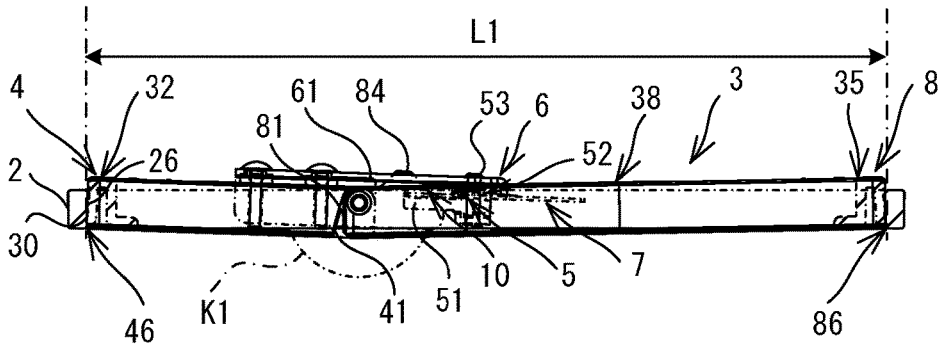

EMBROIDERY FRAME, METHOD FOR CAUSING SEWING OBJECT TO BE HELD ON EMBROIDERY FRAME, AND INNER FRAME OF EMBROIDERY FRAME

CROSS-REFERENCE TO RELATED APPLICATION

This application claims priority to Japanese Patent Application No. 2020-057178 filed Mar. 27, 2020, the content of which is hereby incorporated herein by reference in its entirety.

BACKGROUND

The present disclosure relates to an embroidery frame, a method for causing a sewing object to be held on an embroidery frame, and an inner frame of an embroidery frame.

A known embroidery frame is provided with an outer frame, an inner frame, a pair of screw mounting portions, an adjustment screw, an operation shaft, and a coupling mechanism. The outer frame has a shape in which a frame-shaped member is divided. The pair of screw mounting portions are respectively provided on a pair of divided end portions of the outer frame. The adjustment screw is inserted through the pair of screw mounting portions and can be used to adjust an interval between the pair of end portions of the outer frame. A user rotates the adjustment screw by operating the operation shaft. The coupling mechanism transmits a rotational torque of the operation shaft to the adjustment screw. When the user rotates the adjustment screw using the operation shaft, the interval between the pair of screw mounting portions is narrowed, and in a state in which the sewing object is clamped between the outer frame and the inner frame of the embroidery frame, the outer frame is tightened with respect to the inner frame.

SUMMARY

With the above-described embroidery frame, in some cases, depending on a type, a thickness, and the like of the sewing object, an operation to cause the embroidery frame to hold the sewing object in a stretched state becomes troublesome.

Embodiments of the broad principles derived herein provide an embroidery frame capable of holding a sewing object in a stretched state using a simpler operation than in related art, a method for causing a sewing object to be held on an embroidery frame, and an inner frame of an embroidery frame.

Embodiments provide an embroidery frame that includes a frame-shaped outer frame and an inner frame configured to hold a sewing object together with the outer frame. The inner frame includes a first member provided with a restriction portion, and a second member configured to be rotatably supported around a rotating shaft between a first position and a second position with respect to the first member. The first member and the second member of the inner frame form a frame shape along an inner periphery of the outer frame when the second member is in the first position with respect to the first member. The second position is a position at which an angle of the second member with respect to the first member is a contact angle larger than 0 degrees and less than 180 degrees on one side in a circumferential direction of the rotating shaft. The second member includes a contact portion which comes into contact with the restriction portion when the second member is in the second position with respect to the first member and which restricts the second member from rotating further to another side in the circumferential direction than the second position with respect to the first member. A first distance between a first end portion and a second end portion when the second member is in the first position with respect to the first member is longer than a second distance between the first end portion and the second end portion when the second member is in the second position with respect to the first member. The first end portion is a farthest section of the first member from the rotating shaft in a radius direction orthogonal to the rotating shaft, and the second end portion is a farthest section of the second member from the rotating shaft in the radius direction.

Embodiments also provide a method for causing a sewing object to be held on an embroidery frame that includes a sewing object arrangement process of arranging a sewing object on a frame-shaped outer frame, and an inner frame arrangement process of arranging, on an inner side of an inner periphery of the outer frame on which the sewing object is arranged, an inner frame which includes a first member and a second member configured to be rotatably supported around a rotating shaft between a first position and a second position with respect to the first member and in which the first member and the second member form a frame shape along the inner periphery of the outer frame, when the second member is in the second position at which an angle of the second member with respect to the first member is a contact angle larger than 0 degrees and smaller than 180 degrees on one side in a circumferential direction of the rotating shaft, and of causing a first end portion of the first member and a second end portion of the second member to come into contact with the sewing object arranged on the outer frame. The first end portion is most separated from the rotating shaft in a radius direction orthogonal to the rotating shaft, and the second end portion is most separated from the rotating shaft in the radius direction. The method further includes a holding process of causing the sewing object to be held by the outer frame and the inner frame. The holding process includes moving the second member to the first position with respect to the first member by pressing the inner frame arranged in the inner frame arrangement process to the sewing object side to widen a distance between the first end portion and the second end portion in comparison to when the second member is in the second position with respect to the first member.

Embodiments further provide an inner frame of an embroidery frame that includes a first member provided with a restriction portion, and a second member configured to be rotatably supported around a rotating shaft between a first position and a second position with respect to the first member. The first member and the second member of the inner frame form a frame shape along an inner periphery of a frame-shaped outer frame when the second member is in the first position with respect to the first member. The second position is a position at which an angle of the second member with respect to the first member is a contact angle larger than 0 degrees and less than 180 degrees on one side in a circumferential direction of the rotating shaft. The second member includes a contact portion which comes into contact with the restriction portion when the second member is in the second position with respect to the first member and which restricts the second member from rotating further to another side in the circumferential direction than the second position with respect to the first member. A first distance between a first end portion and a second end portion when the second member is in the first position with respect to the first member is longer than a second distance between the first end portion and the second end portion when the second member is in the second position with respect to the first member. The first end portion is a farthest section of the first member from the rotating shaft in a radius direction orthogonal to the rotating shaft, and the second end portion is a farthest section of the second member from the rotating shaft in the radius direction.

BRIEF DESCRIPTION OF THE DRAWINGS

Embodiments will be described below in detail with reference to the accompanying drawings in which:

FIG. 6A is a right-side view of the left-side portion of the inner frame when the second member is in the second position with respect to the first member, and FIG. 6B is a right-side view of the left-side portion of the inner frame when the second member is in the first position with respect to the first member;

DETAILED DESCRIPTION

Hereinafter, an embroidery frame 1 of an embodiment, and an inner frame 3 of the embroidery frame 1 will be explained with reference to the drawings. The upper side, the lower side, the left-side and the right-side in FIG. 1 are, respectively, the left-side, the right-side, the front side and the rear side of the embroidery frame 1 and the inner frame 3.

Figure 1:
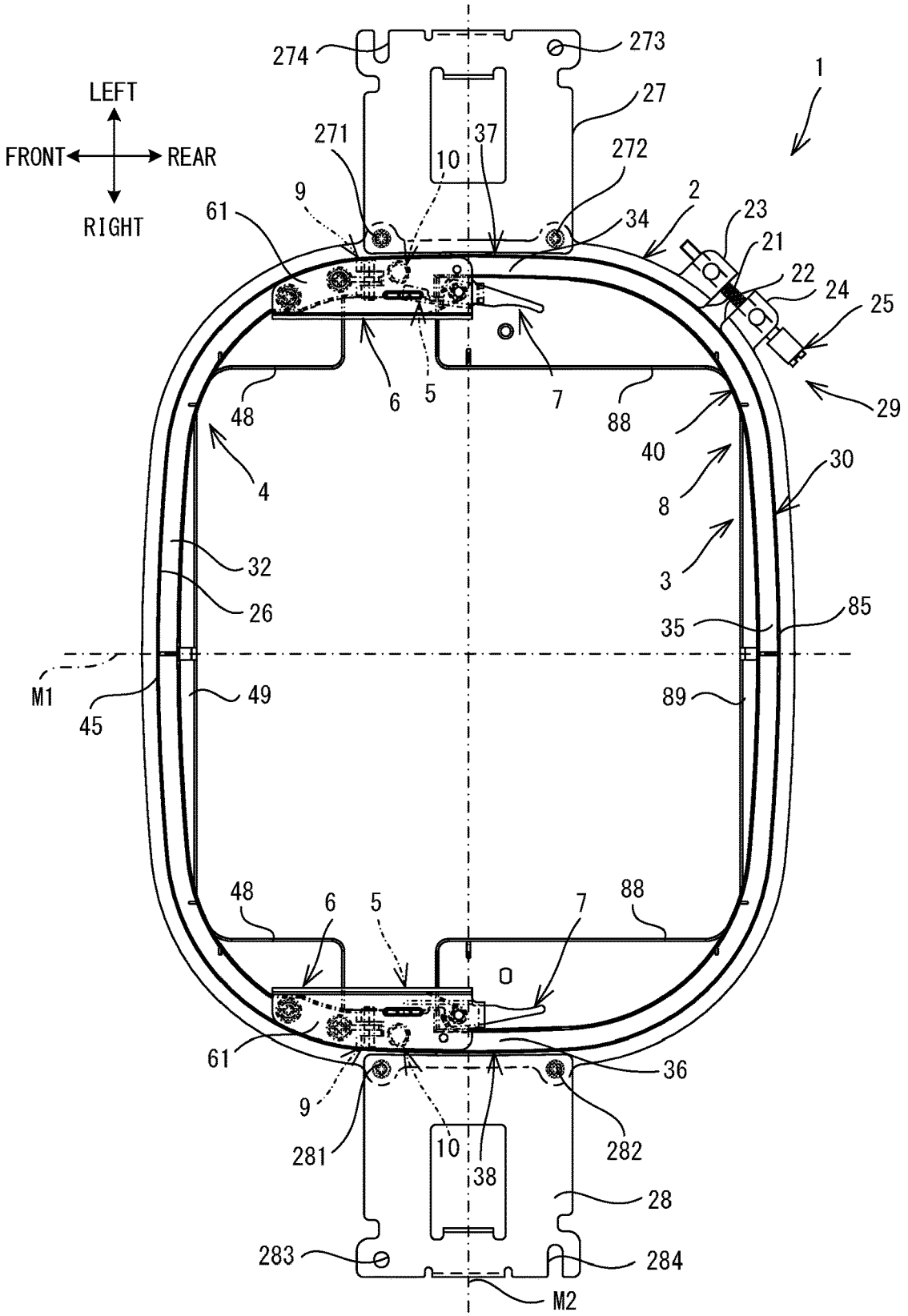
FIG. 1 is a plan view of an embroidery frame.

As shown in FIG. 1, the embroidery frame 1 is an embroidery frame which is used to sew an embroidery pattern and which is mounted on a sewing machine capable of embroidery sewing, such as a multi-needle sewing machine (not shown in the drawings) that is provided with a plurality of needle bars. The embroidery frame 1 is provided with an outer frame 2, the inner frame 3, and a pair of left and right coupling portions 27 and 28. The outer frame 2 and the inner frame 3 can hold a sewing object C (refer to FIG. 7) that is to be embroidered. Each of the outer frame 2 and the inner frame 3 is long in the left-right direction, and is a rectangular frame-shaped member having rounded corners. An inner periphery 26 of the outer frame 2 has substantially the same shape as an outer periphery 30 of the inner frame 3, and the inner frame 3 is removably fitted with the inner side of the outer frame 2. The sewing object C is clamped between the outer frame 2 and the inner frame 3, and is held in a stretched state on the embroidery frame 1.

The left and right coupling portions 27 and 28 are portions that are mounted on and supported by a mounting portion of a multi-needle sewing machine. Each of the coupling portions 27 and 28 is a rectangular plate member. The left coupling portion 27 is fixed to a left portion of the outer frame 2 using screws 271 and 272 at two positions of a right end portion of the left coupling portion 27. The right coupling portion 28 is fixed to a right portion of the outer frame 2 using two screws 281 and 282 at two positions of a left end portion of the right coupling portion 28. An engagement hole 273 is provided in the vicinity of a rear left portion of the left coupling portion 27, and an engagement groove 274 is provided in the vicinity of a front left portion of the left coupling portion 27. An engagement hole 283 is provided in the vicinity of a front right end portion of the right coupling portion 28, and an engagement groove 284 is provided in the vicinity of a rear right end portion of the right coupling portion 28. The engagement holes 273 and 283, and the engagement grooves 274 and 284 are used to fix the coupling portions 27 and 28 to correct positions of the mounting portion of the multi-needle sewing machine.

The outer frame 2 is provided with end portions 21 and 22, the inner periphery 26, and a tightening mechanism 29. The end portions 21 and 22 are provided on a rear left corner portion of the outer frame 2, and are portions at which an annular frame member is divided. The end portions 21 and 22 are separated from each other. The inner periphery 26 has a rectangular frame shape having rounded corners. The tightening mechanism 29 is provided with a pair of screw mounting portions 23 and 24 and an adjustment screw 25. The pair of screw mounting portions 23 and 24 are coupled to the end portions 21 and 22, respectively. The adjustment screw 25 is fastened to the pair of screw mounting portions 23 and 24. After the adjustment screw 25 is fastened to the pair of screw mounting portions 23 and 24, when the adjustment screw 25 is further rotated in a fastening direction, an interval between the end portions 21 and 22 becomes narrower than that before the operation on the adjustment screw 25, and the outer frame 2 is tightened with respect to the inner frame 3. After the adjustment screw 25 is fastened to the pair of screw mounting portions 23 and 24, when the adjustment screw 25 is rotated in an opposite direction to the fastening direction, the interval between the end portions 21 and 22 becomes wider than that before the operation on the adjustment screw 25, and the tightening of the outer frame 2 with respect to the inner frame 3 is released.

Figure 2:
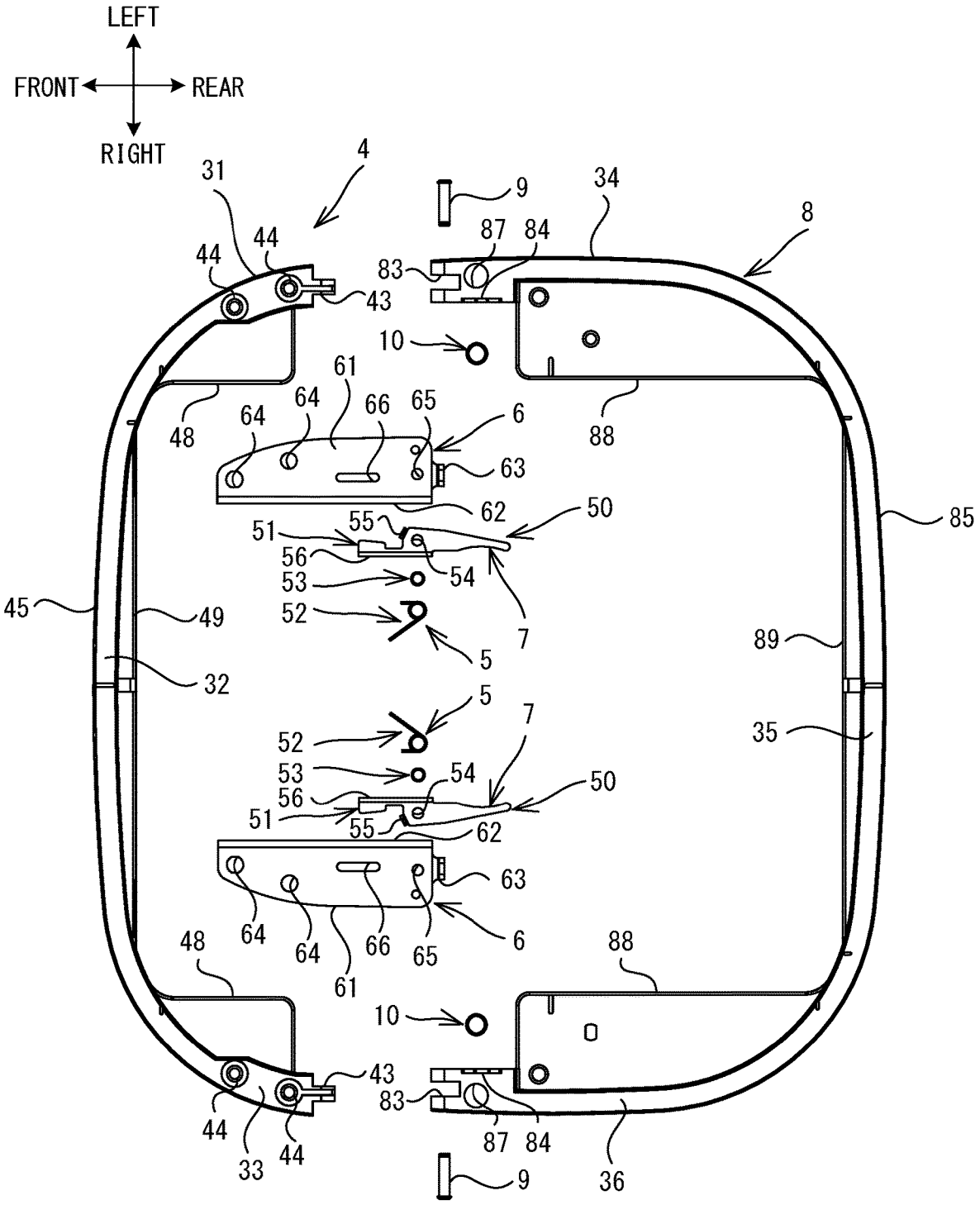
FIG. 2 is a plan view of a disassembled inner frame.
Figure 3:
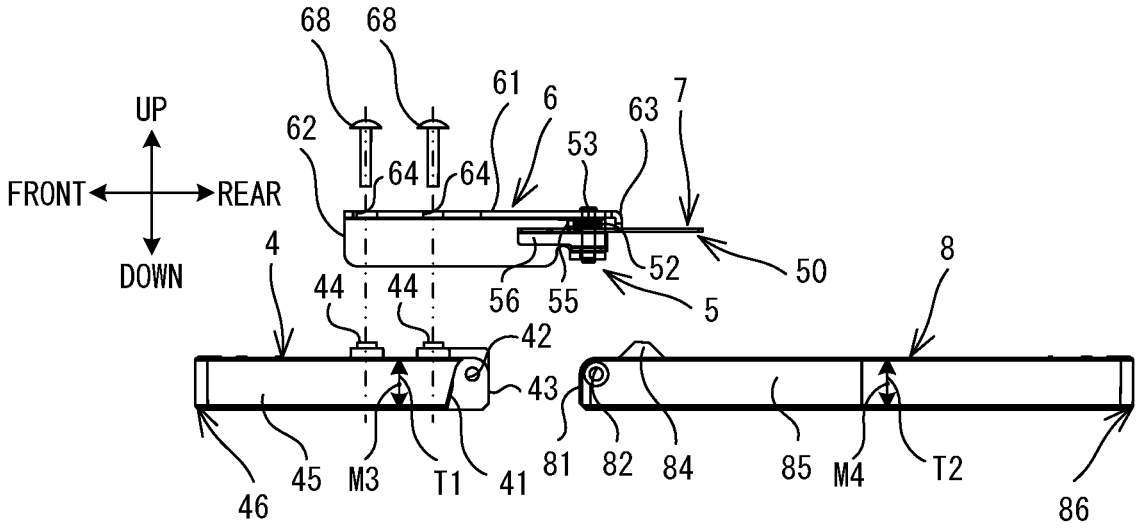
FIG. 3 is a right-side view of the disassembled inner frame.

As shown in FIG. 1 to FIG. 6, the inner frame 3 is provided with a first member 4, a second member 8, and a pair of rotating shafts 9. In the explanation below, a direction from the outer periphery 30 of the inner frame 3 toward an inner periphery 40 of the inner frame 3 will be referred to as an inner side of the embroidery frame 1, the outer frame 2, and the inner frame 3. A direction from the inner periphery 40 of the inner frame 3 toward the outer periphery 30 will be referred to as an outer side of the embroidery frame 1, the outer frame 2, and the inner frame 3. The inner frame 3 has a left-right symmetrical shape taking, as a reference, a center M1 of the inner frame 3 in the left-right direction. As shown in FIG. 2, the first member 4 includes a left-side portion 31, a right-side portion 33, and a front side portion 32, and has a U shape having an open rear side in a plan view. The front side portion 32 is coupled to the front-end of the left-side portion 31 and to the front-end of the right-side portion 33, and extends in the left-right direction. As shown in FIG. 2 and FIG. 3, each of the left-side portion 31 and the right-side portion 33 of the first member 4 is provided with a restriction portion 41, a protruding portion 43, a hole 42, and a pair of screw hole portions 44. Hereinafter, the structure of each of the members provided on the left-side portion 31 of the first member 4 will be explained, and an explanation of the structure of each of the members provided on the right-side portion 33 will be omitted. The restriction portion 41 has a shape inclined diagonally downward toward the front. The protruding portion 43 is a section that protrudes further to the rear than the restriction portion 41. The protruding portion 43 is provided on a rear end portion of the left-side portion 31 of the first member 4, at a central portion of the first member 4 in a thickness direction (the left-right direction at the rear end portion of the first member 4). The hole 42 is a hole that is provided in the protruding portion 43 and that penetrates in the left-right direction. Each of the pair of screw hole portions 44 protrudes upward from the upper surface of the first member 4, and includes a screw hole that extends in the up-down direction.

The first member 4 is further provided with an outer periphery 45, a first end portion 46, a pair of left and right ribs 48, and a rib 49. The outer periphery 45 has a shape along the shape of the inner periphery 26 of the outer frame 2. The first end portion 46 is the farthest section of the first member 4 from the rotating shafts 9 in a radius direction that is orthogonal to the rotating shafts 9. In the present embodiment, the first end portion 46 is a lower front-end portion of the first member 4. The first end portion 46 is positioned at the center M1 (refer to FIG. 1) of the first member 4 in the left-right direction. The pair of left and right ribs 48 are respectively provided on the left-side portion 31 and the right-side portion 33 of the first member 4, and are sections that protrude to the inner side from the inner periphery 40 of the inner frame 3 and that extend in the horizontal direction. The rib 49 is provided on the front side portion 32 of the first member 4, and is a section that protrudes to the inner side from the inner periphery 40 of the inner frame 3 and that extends in the horizontal direction. The pair of ribs 48 and the rib 49 reinforce the inner frame 3, and make stretching of the sewing object C easier when the sewing object C is held by the outer frame 2 and the inner frame 3.

The second member 8 is rotatably supported around the rotating shafts 9 between a first position and a second position (to be described later) with respect to the first member 4. The second member 8 is disposed to the rear of the first member 4. The second member 8 includes a left-side portion 34, a right-side portion 36, and a rear side portion 35, and has a U shape having an open front side in a plan view. The rear side portion 35 is coupled to the rear end of the left-side portion 34 and to the rear end of the right-side portion 36, and extends in the left-right direction. As shown in FIG. 1, the left-side portion 34 and the left-side portion 31 of the first member 4 together form a left-side portion 37 of the inner frame 3. The right-side portion 36 and the right-side portion 33 of the first member 4 together form a right-side portion 38 of the inner frame 3. As shown in FIG. 3, a thickness T2 of the second member 8 is the same as a thickness T1 of the first member 4. The thickness T2 of the second member 8 and the thickness T1 of the first member 4 are larger than a thickness T3 of the outer frame 2 shown in FIG. 6. As shown in FIG. 2 and FIG. 3, the length of the second member 8 in the front-rear direction is longer than the length of the first member 4 in the front-rear direction.

Each of the front-end portion of the left-side portion 34 of the second member 8 and the front-end portion of the right-side portion 36 of the second member 8 is provided with a contact portion 81, a hole 82, a recessed portion 83, a protruding portion 84, and a housing recessed portion 87. Hereinafter, the structure of each of the members provided at the left-side portion 34 of the second member 8 will be explained, and the structure of each of the members provided at the right-side portion 36 will be omitted. When the second member 8 is in the second position with respect to the first member 4, the contact portion 81 comes into contact with the corresponding restriction portion 41, and restricts the second member 8 from rotating around the rotating shafts 9 further in a clockwise direction in a right-side view than the second position with respect to the first member 4. Thus, the first member 4 and the second member 8 are not folded in a posture in which the lower surface of the first member 4 comes into contact with the lower surface of the second member 8.

Figure 4A:
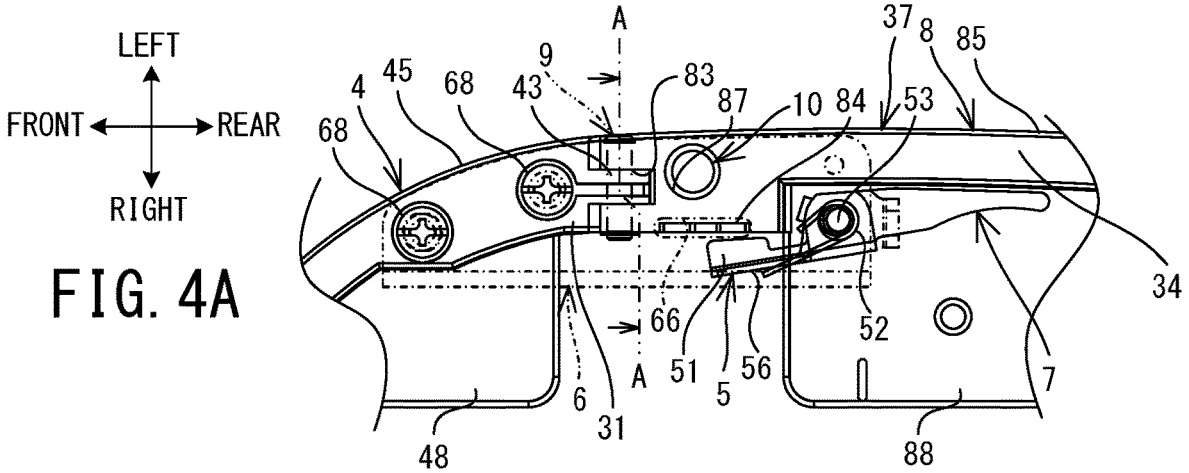
FIG. 4A is a plan view of a left-side portion of the inner frame when a second member is in a second position with respect to a first member.

As shown in FIG. 3, the hole 82 is a hole that penetrates in the left-right direction. The length from the lower surface of the second member 8 to the hole 82 is the same as the length from the lower surface of the first member 4 to the hole 42. As shown in FIG. 2, the recessed portion 83 is a portion that is recessed to the rear and that is provided in the front-end portion of the left-side portion 34 of the second member 8. The recessed portion 83 is provided in the front-end portion of the left-side portion 34, at a central portion of the second member 8 in the thickness direction (the left-right direction at the front-end portion of the second member 8). The protruding portion 43 of the first member 4 is disposed in the recessed portion 83. As shown in FIG. 4A, in a state in which the protruding portion 43 is disposed in the recessed portion 83, when the rotating shaft 9 is inserted through the hole 42 of the first member 4 and the hole 82 of the second member 8, the second member 8 is rotatably supported with respect to the first member 4. As shown in FIG. 2 and FIG. 3, the protruding portion 84 is a triangular plate-shaped portion, in a right-side view, that is provided on the inner peripheral side of the left-side portion 34 of the second member 8 and that extends upward. The housing recessed portion 87 is a columnar recessed portion that is provided in the upper surface of the second member 8, and is positioned to the rear of the recessed portion 83 and to the left of the protruding portion 84.

As shown in FIG. 1 to FIG. 3, the second member 8 is further provided with an outer periphery 85, a second end portion 86, a pair of left and right ribs 88, and a rib 89. The outer periphery 85 has a shape along the shape of the inner periphery 26 of the outer frame 2. The outer periphery 85 and the outer periphery 45 of the first member 4 together form the outer periphery 30 of the inner frame 3. The second end portion 86 is the farthest section of the second member 8 from the rotating shafts 9 in the radius direction that is orthogonal to the rotating shafts 9. In the present embodiment, the second end portion 86 is a lower rear end portion of the second member 8. The pair of left and right ribs 88 are respectively provided on the left-side portion 34 and the right-side portion 36 of the second member 8, and are sections that protrude to the inner side from the inner periphery 40 of the inner frame 3 and that extend in the horizontal direction. The rib 89 is provided on the rear side portion 35 of the second member 8, and is a section that protrudes to the inner side from the inner periphery 40 of the inner frame 3 and that extends in the horizontal direction.

Each of the pair of rotating shafts 9 is a shaft that is inserted through the hole 42 and the hole 82 and that extends in the left-right direction. In the left-side portion 37 and the right-side portion 38 of the inner frame 3, the pair of rotating shafts 9 are respectively disposed at positions that are separated from a center M2 of the inner frame 3 in the front-rear direction. The rotating shafts 9 of the present embodiment are positioned to the front of the center M2 of the inner frame 3 in the front-rear direction, and extend in the left-right direction. The positions of the pair of rotating shafts 9 in the front-rear direction overlap with the positions of the coupling portions 27 and 28 in the front-rear direction. As shown in FIG. 6A, when the second member 8 is in the second position with respect to the first member 4, the rotating shaft 9 is positioned on a side that is further separated from a virtual plane V in the thickness direction of the first member 4 than a center M3 of the first member 4 in the thickness direction, and on a side that is further separated from the virtual plane V in the thickness direction of the second member 8 than a center M4 of the second member 8 in the thickness direction. The virtual plane V is a virtual plane that is in contact with the first end portion 46 and the second end portion 86, and that is parallel to the rotating shaft 9.

When the second member 8 is in the first position with respect to the first member 4, the first member 4 and the second member 8 of the inner frame 3 form a frame shape along the inner periphery 26 of the outer frame 2, and the inner frame 3 can hold the sewing object C together with the outer frame 2. As shown in FIG. 6B, the first position is a position at which an angle of the second member 8 with respect to the first member 4 is a holding angle K1 that is larger than 180 degrees on one side in a circumferential direction. The angle of the second member 8 with respect to the first member 4 is defined such that 0 degrees corresponds to a state in which the lower surface of the first member 4 and the lower surface of the second member 8 face and overlap each other, and an angle formed between the lower surface of the first member 4 and the lower surface of the second member 8 is represented in a range from 0 to 360 degrees. In the inner frame 3 of the present embodiment, the lower surface of each of the first member 4 and the second member 8 is, of two surfaces that are orthogonal to the thickness direction of the inner frame 3, a surface on a side facing the sewing object C. When the second member 8 is in the second position with respect to the first member 4, the lower surface of each of the first member 4 and the second member 8 is, of the two surfaces orthogonal to the thickness direction of the inner frame 3, a surface positioned on a side closer to the virtual plane V. The circumferential direction is a direction around the rotating shaft 9, and in FIG. 6B, the one side in the circumferential direction is an angle in a counterclockwise direction from the first member 4 in a right-side view. When the second member 8 is in the second position with respect to the first member 4, when the inner frame 3 is disposed on the inner side of the inner periphery 26 of the outer frame 2 and thereafter the second member 8 is moved to the first position with respect to the first member 4, each of the first end portion 46 and the second end portion 86 comes into contact with the inner periphery 26 of the outer frame 2, the outer periphery 30 of the front side portion 32 of the inner frame 3 comes close to the inner periphery 26 of the outer frame 2, and the outer periphery 30 of the rear side portion 35 comes close to the inner periphery 26 of the outer frame 2.

As shown in FIG. 6A, the second position is a position at which the angle of the second member 8 with respect to the first member 4 is a contact angle K2 that is larger than 0 degrees and smaller than 180 degrees on the one side in the circumferential direction of the rotating shaft 9. The contact angle K2 of the present embodiment is an angle that is equal to or more than 90 degrees and less than 180 degrees on the one side in the circumferential direction. An absolute value of a difference between the holding angle K1 and 180 degrees is smaller than an absolute value of a difference between the contact angle K2 and 180 degrees. When the second member 8 is in the second position with respect to the first member 4, a shaft distance D is less than twice the thickness T3 of the outer frame 2. The shaft distance D is a distance between the rotating shaft 9 and the virtual plane V that is parallel to the rotating shaft 9 and that is in contact with the first end portion 46 and the second end portion 86 when the second member 8 is in the second position with respect to the first member 4. When the second member 8 is in the second position with respect to the first member 4, when the inner frame 3 is disposed on the inner side of the inner periphery 26 of the outer frame 2, each of the first end portion 46 and the second end portion 86 is separated from the inner periphery 26 of the outer frame 2, the outer periphery 30 of the front side portion 32 of the inner frame 3 comes into contact with the upper end portion of the inner periphery 26 of the outer frame 2, and the outer periphery 30 of the rear side portion 35 comes into contact with the upper end portion of the inner periphery 26 of the outer frame 2. When the second member 8 is in the second position with respect to the first member 4, when the inner frame 3 is disposed on the inner side of the inner periphery 26 of the outer frame 2, each of the outer periphery 30 of the left-side portion 37 of the inner frame 3 and the outer periphery 30 of the right-side portion 38 partially comes into contact with the inner periphery 26 of the outer frame 2 in the front-rear direction. In the embroidery frame 1, when the second member 8 is in the second position with respect to the first member 4, when the inner frame 3 is disposed on the inner side of the inner periphery 26 of the outer frame 2, a ratio of a part of the outer frame 2 that can clamp the sewing object C together with the inner frame 3 in the second position is large, and a ratio of a part of the outer frame 2 that cannot clamp the sewing object C together with the inner frame 3 is small, in comparison to an embroidery frame in which the shaft distance D is equal to or more than twice the thickness T3 of the outer frame 2.

As shown in FIG. 6A and FIG. 6B, a first distance L1 is longer than a second distance L2. The first distance L1 is a distance between the first end portion 46 and the second end portion 86 when the second member 8 is in the first position with respect to the first member 4. The second distance L2 is a distance between the first end portion 46 and the second end portion 86 when the second member 8 is in the second position with respect to the first member 4. The second distance L2 is preferably equal to or more than 75 percent and less than 100 percent of the first distance L1, and more preferably, equal to or more than 87.5 percent and less than 100 percent of the first distance L1.

As shown in FIG. 1 to FIG. 3, each of the left-side portion 37 and the right-side portion 38 of the inner frame 3 is further provided with a restriction member 6, a lock mechanism 5, a lock release member 7, and an urging member 10. Hereinafter, the structure of each of the members provided on the left-side portion 37 of the inner frame 3 will be explained, and an explanation of the structure of each of the members provided on the right-side portion 38 will be omitted. The restriction member 6 restricts the second member 8 from rotating from the first position to the one side in the circumferential direction with respect to the first member 4. The restriction member 6 is formed by processing a metal plate, for example. The restriction member 6 is provided with plate portions 61 to 63, and screws 68. The plate portion 61 is a plate-shaped portion that is long in the front-rear direction, and extends parallel to the upper surface of the first member 4. As shown in FIG. 1, an outer peripheral shape of a front left portion of the plate portion 61 is a shape along the inner periphery 26 of the outer frame 2. The right end portion of the plate portion 61 extends linearly in the front-rear direction. As shown in FIG. 2, the plate portion 61 is provided with a pair of holes 64 and holes 65 and 66, each of which penetrates in the up-down direction. The pair of holes 64 are circular holes in a plan view, and are provided in a left portion of the plate portion 61. The restriction member 6 is fixed to the left-side portion 34 of the first member 4 using the pair of screws 68 (refer to FIG. 3) that are respectively inserted through the pair of holes 64 of the restriction member 6 and the pair of screw hole portions 44 of the first member 4. The hole 65 is a circular hole in a plan view, and is provided in a rear right portion of the plate portion 61. The hole 66 is a long hole that is long in the front-rear direction in a plan view, and is provided between the pair of holes 64 and the hole 65 in the front-rear direction. The protruding portion 84 of the second member 8 is inserted through the hole 66. When a lock engaging portion 51 to be described later is disposed higher than the upper surface of the inner frame 3, the protruding portion 84 comes into contact with the lock engaging portion 51, and restricts the lock engaging portion 51 from moving to a position that faces the upper surface of the inner frame 3. The plate portion 62 extends downward from the right end of the plate portion 61. The length of the plate portion 62 in the up-down direction substantially matches the thickness of the first member 4. The plate portion 63 extends downward from the rear end of the plate portion 61. As shown in FIG. 3, the length of the plate portion 63 in the up-down direction is shorter than the length of the plate portion 62 in the up-down direction.

Figure 5A:
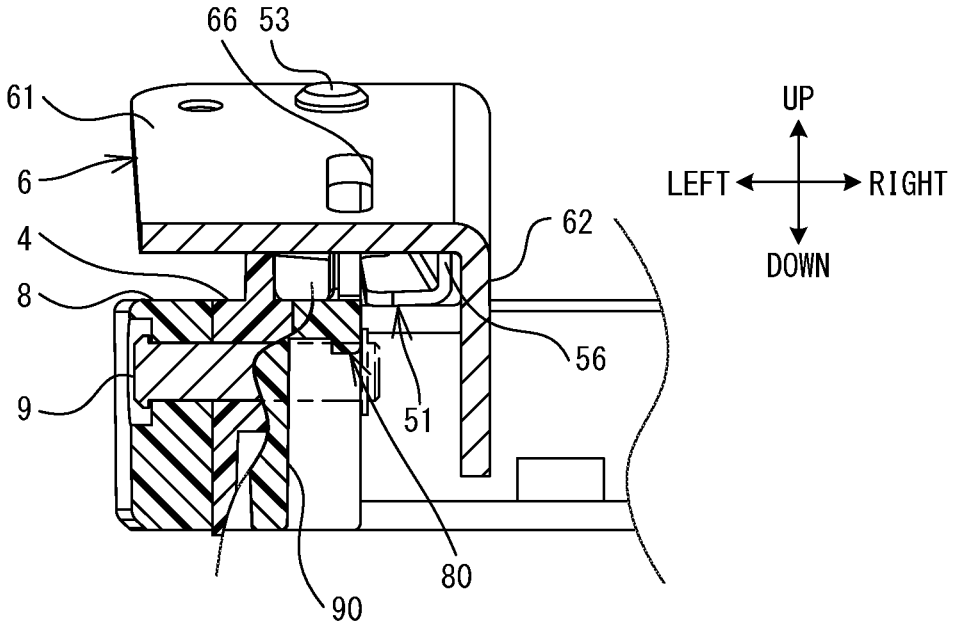
FIG. 5A is a cross-sectional view in the direction of arrows along a line A-A shown in FIG. 4A.
Figure 5B:
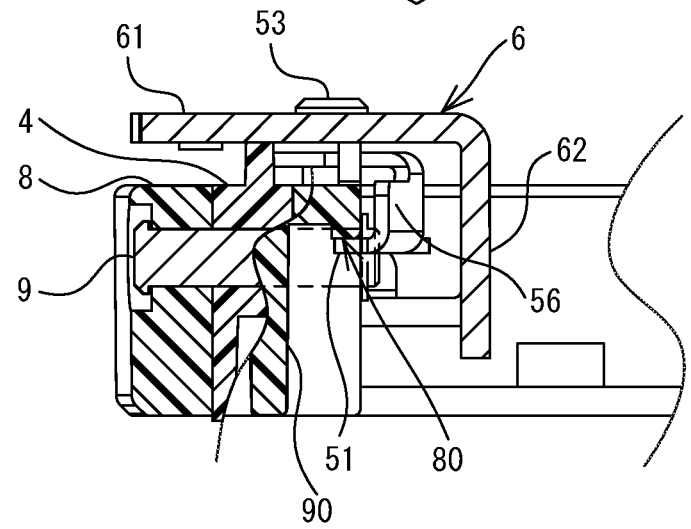
FIG. 5B is a cross-sectional view in the direction of arrows along a line B-B shown in FIG. 4B.

As shown in FIG. 2 and FIG. 3, when the second member 8 is in the first position with respect to the first member 4, the lock mechanism 5 restricts the second member 8 from rotating from the first position with respect to the first member 4. The lock mechanism 5 is provided with a rotating shaft 53, the lock engaging portion 51, a lock urging member 52, and a lock engaged portion 80 (refer to FIG. 5A and FIG. 5B). The rotating shaft 53 is a shaft that extends in the thickness direction of the first member 4, and is inserted through the hole 65 of the restriction member 6 and a hole 54 of the plate-shaped member 50. The lock engaging portion 51 is movably provided on one selected from the group of the first member 4 and the second member 8. The lock engaging portion 51 of the present embodiment is a front side portion of the plate-shaped member 50 that is long in the front-rear direction, and is attached to the restriction member 6 fixed to the first member 4. The lock engaging portion 51 is provided to the front of the rotating shaft 53 inserted through the center of the plate-shaped member 50 in the front-rear direction. As shown in FIG. 5A and FIG. 5B, the lock engaging portion 51 is a portion that extends parallel to the plate portion 61 of the restriction member 6, and is coupled to a right portion 56 that extends perpendicularly to the plate portion 61 of the restriction member 6. The lock engaging portion 51 can rotate around the rotating shaft 53, in parallel with the plate portion 61 of the restriction member 6.

Figure 4B:
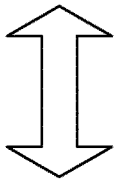
FIG. 4B is a plan view of the left-side portion when the second member is in a first position with respect to the first member.
Figure 4B:
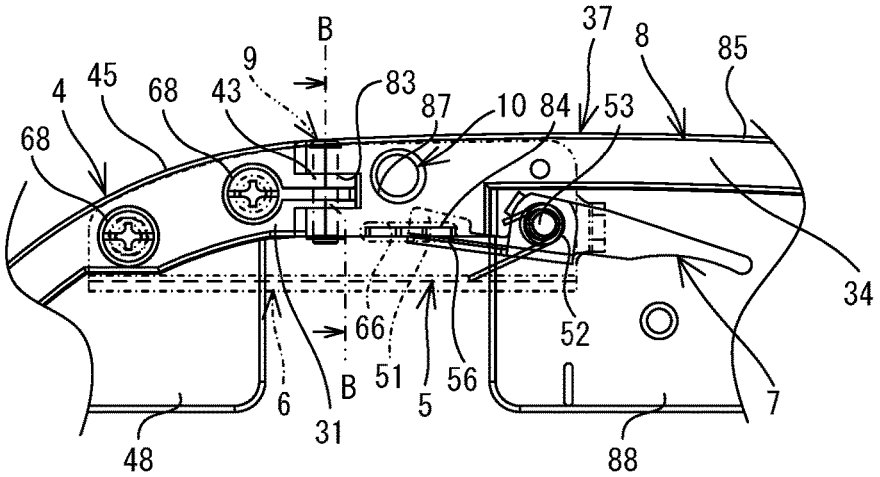

As shown in FIG. 2 to FIG. 4, the lock urging member 52 is provided on one selected from the group of the first member 4 and the second member 8, and urges the lock engaging portion 51 in a direction intersecting a plane that forms the outer periphery 30 of the inner frame 3. The lock urging member 52 of the present embodiment is a torsion spring, through which the rotating shaft 53 is inserted, and is attached to the restriction member 6 fixed to the first member 4. As shown in FIG. 3, the lock urging member 52 is disposed between the plate portion 61 of the restriction member 6 and the plate-shaped member 50 in the up-down direction. The lock urging member 52 urges the lock engaging portion 51 in the clockwise direction in a plan view, around the rotating shaft 53. As shown in FIG. 5A and FIG. 5B, the lock engaged portion 80 is provided on the other selected from the group of the first member 4 and the second member 8. When the second member 8 is rotated to the first position with respect to the first member 4, the lock engaged portion 80 engages with the lock engaging portion 51 that is moved by an urging force of the lock urging member 52. The lock engaged portion 80 of the present embodiment is provided in a recessed portion 90 that is recessed outward from the inner periphery of the second member 8. The lock engaged portion 80 is a portion that protrudes downward in a front portion of the recessed portion 90. As shown in FIG. 5B, when the second member 8 is in the first position with respect to the first member 4 and the lock engaged portion 80 is engaged with the lock engaging portion 51, the lower surface of the lock engaged portion 80 comes into contact with the upper surface of the lock engaging portion 51, and the right-side surface of the lock engaged portion 80 faces the left-side surface of the right portion 56. As shown in FIG. 5A, when the second member 8 is not in the first position with respect to the first member 4 and the engagement of the lock engaged portion 80 with the lock engaging portion 51 is released, the lock engaged portion 80 is separated from the lock engaging portion 51.

As shown in FIG. 1 to FIG. 4, the lock release member 7 can move the lock engaging portion 51 against the urging force of the lock urging member 52, and can thus release the engagement between the lock engaging portion 51 and the lock engaged portion 80. The lock release member 7 of the present embodiment is a lever-shaped member that is formed on the right-side portion of the plate-shaped member 50. More specifically, the lock release member 7 of the present embodiment is a member integrated with the lock engaging portion 51. The lock release member 7 extends further to the rear than the rear end of the restriction member 6. The upper surface of the lock release member 7 comes into contact with the plate portion 63. The plate-shaped member 50 is provided with a protruding portion 55 that protrudes upward and that is positioned to the front and left of the hole 54. The protruding portion 55 comes into contact with the lower surface of the plate portion 61 of the restriction member 6. The plate-shaped member 50 is maintained in a posture parallel to the plate portion 61 by the protruding portion 55 and the plate portion 63. The urging member 10 urges the second member 8 to another side in the circumferential direction with respect to the first member 4. The other side in the circumferential direction is the clockwise direction in a right-side view, of the directions around the rotating shaft 9. The urging member 10 of the present embodiment is a coil spring disposed in the housing recessed portion 87 of the second member 8. The urging member 10 is disposed between the bottom surface of the housing recessed portion 87 and the lower surface of the plate portion 61. The urging member 10 comes into contact with each of the second member 8 and the first member 4.

Figure 7:
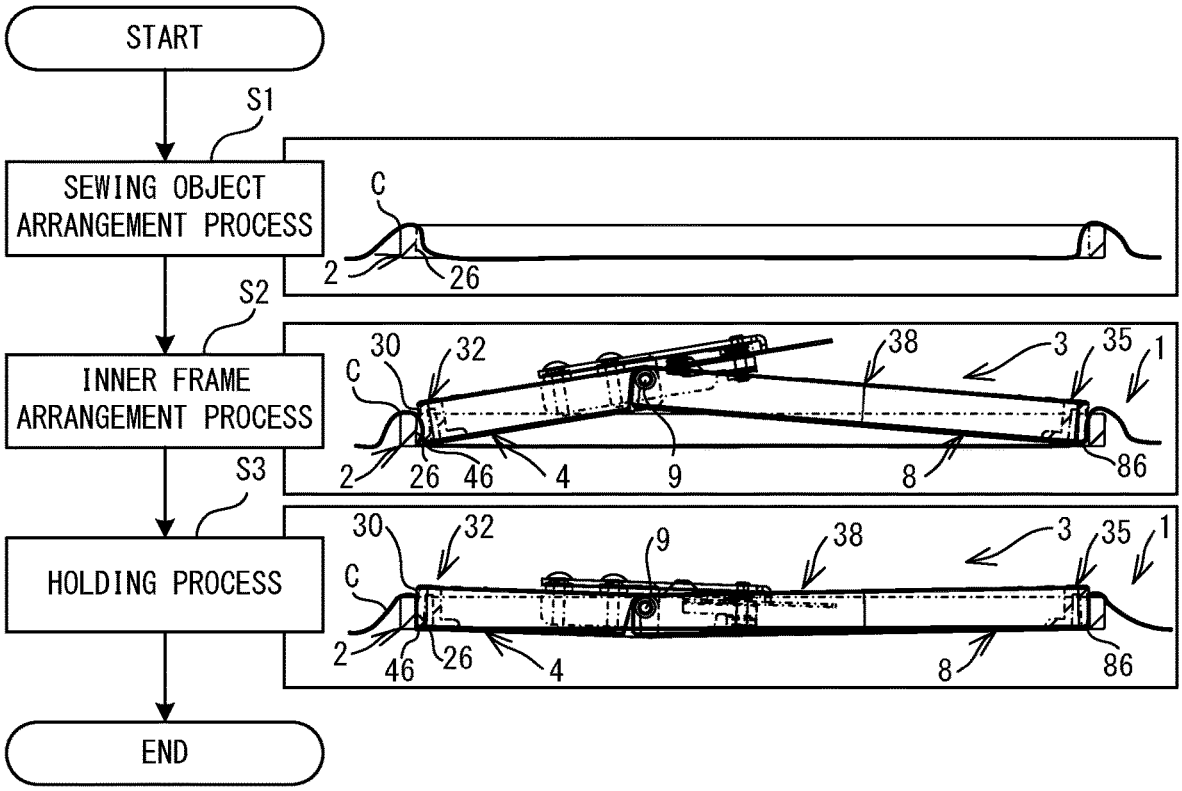
FIG. 7 is a flowchart of a method for causing a sewing object to be held on the embroidery frame.

A method for holding the sewing object C using the embroidery frame 1 will be explained with reference to FIG. 7. As shown in FIG. 7, first, a user performs a sewing object arrangement process of arranging the sewing object C on the frame-shaped outer frame 2 (step S1). For example, the user arranges the sewing object C so as to cover the upper surface of the outer frame 2. In a state in which the second member 8 is in the second position at which the angle of the second member 8 with respect to the first member 4 is the contact angle K2 that is larger than 0 degrees and smaller than 180 degrees on the one side in the circumferential direction of the rotating shaft 9, the user performs an inner frame arrangement process of arranging the inner frame 3 on the inner side of the inner periphery 26 of the outer frame 2 on which the sewing object C is arranged (step S2). Through the process at step S2, the first end portion 46 of the first member 4 and the second end portion 86 come into contact with the upper surface of the sewing object C arranged on the outer frame 2. When the second member 8 is in the second position with respect to the first member 4, the inner frame 3 is in a gentle inverted V-shaped posture, in a right-side view, in which the second member 8 is bent with respect to the first member 4 in a direction in which the lower surface of the first member 4 and the lower surface of the second member 8 approach each other. When the second member 8 is in the second position with respect to the first member 4, an angle formed between the lower surface of the first member 4 and the sewing object C, and an angle formed between the lower surface of the second member 8 and the sewing object C are each an acute angle. A shape surrounded by the lower surface of the first member 4, the lower surface of the second member 8, and the sewing object C is a triangle. The user adjusts, as appropriate, the arrangement of the sewing object C with respect to the outer frame 2 and a degree of stretch of the sewing object C, and provisionally determines the arrangement of the sewing object C with respect to the outer frame 2. At this time, in comparison to when the second member 8 is in the first position with respect to the first member 4, the sewing object C is clamped lightly by the inner frame 3 and the outer frame 2. Therefore, the user can easily and finely adjust the arrangement of the sewing object C with respect to the outer frame 2.

The user presses the inner frame 3 arranged in the inner frame arrangement process to the sewing object C side, and moves the second member 8 to the first position with respect to the first member 4. Thus, the user widens the distance between the first end portion 46 and the second end portion 86 in comparison to when the second member 8 is in the second position with respect to the first member 4, and performs a holding process of causing the sewing object C to be held by the outer frame 2 and the inner frame 3 (step S3). For example, the user presses down the vicinity of each of the rotating shafts 9 of the inner frame 3. In the course of the movement of the second member 8 from the second position to the first position with respect to the first member 4, the inner frame 3 pulls the sewing object C to the outer side of the inner frame 3. Therefore, the sewing object C is further stretched from the state in which the arrangement with respect to the outer frame 2 is provisionally determined in the inner frame arrangement process. When the second member 8 is in the first position with respect to the first member 4, the restriction member 6 restricts the second member 8 from rotating further to the one side in the circumferential direction than the first position with respect to the first member 4. When the second member 8 is in the first position with respect to the first member 4, the inner frame 3 is in a gentle V-shaped posture, in a right-side view, in which the second member 8 is deflected with respect to the first member 4 in a direction in which the upper surface of the first member 4 and the upper surface of the second member 8 approach each other. When the second member 8 is in the first position with respect to the first member 4, in the up-down direction, the first end portion 46 and the second end portion 86 are at substantially the same position as the lower surface of the outer frame 2, and a section of the inner frame 3 positioned at the lowest side is disposed slightly lower than the lower surface of the outer frame 2. When the second member 8 is in the first position with respect to the first member 4, the entire periphery of the lower surface of the inner frame 3 is in contact with the sewing object C.

When removing the sewing object C from the embroidery frame 1, the user rotates the lock release members 7, which are respectively provided on the left-side portion 37 and the right-side portion 38 of the inner frame 3, around the rotating shafts 53 in a direction approaching the inner periphery 40 of the inner frame 3. The lock release member 7 provided on the left-side portion 37 is rotated in the counterclockwise direction in a plan view around the rotating shaft 53. The lock release member 7 provided on the right-side portion 38 is rotated in the clockwise direction in a plan view around the rotating shaft 53. When each of the lock release members 7 is operated, the lock engaging portion 51 rotates in a direction parallel to the plate portion 61 of the restriction member 6. As a result, the engagement between the lock engaging portion 51 and the lock engaged portion 80 is released, and the second member 8 is allowed to move to the other side in the circumferential direction with respect to the first member 4. When the second member 8 is disposed in the second position with respect to the first member 4, the restriction portion 41 of the first member 4 comes into contact with the contact portion 81 of the second member 8, and the second member 8 is restricted from rotating further to the other side in the circumferential direction than the second position with respect to the first member 4.

The embroidery frame 1 of the above-described embodiment is provided with the frame-shaped outer frame 2 and the inner frame 3. The inner frame 3 includes the first member 4 having the restriction portion 41, and the second member 8 that is rotatably supported around the rotating shafts 9 between the first position and the second position with respect to the first member 4. When the second member 8 is in the first position with respect to the first member 4, the first member 4 and the second member 8 of the inner frame 3 form the frame shape along the inner periphery 26 of the outer frame 2, and the inner frame 3 can hold the sewing object C together with the outer frame 2. The second position is the position at which the angle of the second member 8 with respect to the first member 4 is the contact angle K2 that is larger than 0 degrees and smaller than 180 degrees on the one side in the circumferential direction of the rotating shaft 9. The second member 8 includes the contact portion 81 that comes into contact with the restriction portion 41 when the second member 8 is in the second position with respect to the first member 4, and restricts the second member 8 from rotating further to the other side in the circumferential direction than the second position with respect to the first member 4. The first distance L1 is longer than the second distance L2. The first distance L1 is the distance between the first end portion 46 and the second end portion 86 when the second member 8 is in the first position with respect to the first member 4. The first end portion 46 is the farthest section of the first member 4 from the rotating shafts 9 in the radius direction that is orthogonal to the rotating shafts 9. The second end portion 86 is the section of the farthest second member 8 from the rotating shafts 9 in the radius direction. The second distance L2 is the distance between the first end portion 46 and the second end portion 86 when the second member 8 is in the second position with respect to the first member 4.

Thus, the inner frame 3 of the embroidery frame 1 can allow the second member 8 to rotate around the rotating shafts 9 between the first position and the second position with respect to the first member 4. When the user causes the sewing object C to be held on the embroidery frame 1, for example, the user arranges the inner frame 3 on the inner side of the inner periphery 26 of the outer frame 2 on which the sewing object C is arranged, in the state in which the second member 8 is disposed in the second position with respect to the first member 4. Since the second distance L2 is shorter than the first distance L1, in the state in which the second member 8 is disposed in the second position with respect to the first member 4, the interval in the front-rear direction between the inner periphery 26 of the outer frame 2 and the inner frame 3 is larger than that in the state in which the second member 8 is disposed in the first position with respect to the first member 4. In this state, the user can adjust, as appropriate, and provisionally determine the arrangement of the sewing object C with respect to the outer frame 2, and the degree of stretch of the sewing object C. The user presses the inner frame 3 to the sewing object C side, and thus moves the second member 8 to the first position with respect to the first member 4. The interval between the inner periphery 26 of the outer frame 2 and the inner frame 3 is made narrower than that before the movement, and the sewing object C is held by the outer frame 2 and the inner frame 3. The user can cause the sewing object C to be held by the outer frame 2 and the inner frame 3, by performing a simple operation of pressing the inner frame 3 to the sewing object C side after determining the position of the sewing object C with respect to the outer frame 2. Thus, with a simpler operation than that of related art, the embroidery frame 1 can hold the sewing object C in a stretched state.

As shown in FIG. 6A, the contact angle K2 is the angle that is equal to or more than 90 degrees and less than 180 degrees on the one side in the circumferential direction. With the embroidery frame 1, when the user moves the second member 8 from the state in which the second member 8 is disposed in the second position with respect to the first member 4 to the state in which the second member 8 is disposed in the first position, a distance by which the inner frame 3 is moved downward can be made shorter than when the contact angle K2 is less than 90 degrees on the one side in the circumferential direction. With the embroidery frame 1, when the user moves the second member 8 from the state in which the second member 8 is disposed in the second position with respect to the first member 4 to the state in which the second member 8 is disposed in the first position, a movement amount in the front-rear direction, of the thickness direction of the first member 4, can be made relatively small in comparison to when the contact angle K2 is less than 90 degrees on the one side in the circumferential direction. Therefore, the positioning of the sewing object C with respect to the outer frame 2 is easy. When the user presses the inner frame 3 downward from the state in which the second member 8 is disposed in the second position with respect to the first member 4, the pressing force of the user is transmitted along the extending direction of the first member 4 and the second member 8. Therefore, with the embroidery frame 1, in comparison to when the contact angle K2 is less than 90 degrees on the one side in the circumferential direction, the first end portion 46 and the second end portion 86 can easily move to a side on which they approach the outer frame 2. Thus, with the embroidery frame 1, in comparison to when the contact angle K2 is less than 90 degrees on the one side in the circumferential direction, the operation to move the second member 8, on the inner side of the inner periphery 26 of the outer frame 2 on which the sewing object C is arranged, from the state of being disposed in the second position with respect to the first member 4 to the state of being disposed in the first position, is made easy.

The second distance L2 between the first end portion 46 and the second end portion 86 when the second member 8 is in the second position with respect to the first member 4 is equal to or more than 75 percent and less than 100 percent of the first distance L1 between the first end portion 46 and the second end portion 86 when the second member 8 is in the first position with respect to the first member 4. In the embroidery frame 1, when the inner frame 3 is disposed on the inner side of the inner periphery 26 of the outer frame 2, on which the sewing object C is arranged, in the state in which the second member 8 is disposed in the second position with respect to the first member 4, the ratio of the part of the inner frame 3 disposed facing the outer frame 2 with respect to the inner periphery 26 of the outer frame 2 is large, in comparison to when the second distance L2 is less than 75 percent of the first distance L1. Particularly, of the left-side portion 37 and the right-side portion 38 of the inner frame 3 on which the rotating shafts 9 are respectively provided, the ratio of the part that is disposed facing the outer frame 2 is large. In other words, in the embroidery frame 1, in comparison to when the second distance L2 is less than 75 percent of the first distance L1, of the part of the sewing object C that is in contact with the outer frame 2, the ratio of the part clamped between the outer frame 2 and the inner frame 3 is large, and the arrangement of the sewing object C with respect to the outer frame 2 is provisionally determined in a secure manner. Therefore, with the embroidery frame 1, in comparison to when the second distance L2 is less than 75 percent of the first distance L1, in the course of causing the transition from the state in which the second member 8 is disposed in the second position with respect to the first member 4 to the state in which the second member 8 is disposed in the first position, the arrangement of the sewing object C with respect to the outer frame 2 is unlikely to be displaced, and the sewing object C is easily and appropriately held on the embroidery frame 1.

When the second member 8 is in the second position with respect to the first member 4, the shaft distance D, which is the distance between the rotating shaft 9 and the virtual plane V that is in contact with the first end portion 46 and the second end portion 86 and that is parallel to the rotating shaft 9, is less than twice the thickness T3 of the outer frame 2. Therefore, in the embroidery frame 1, when the inner frame 3 is disposed on the inner side of the inner periphery 26 of the outer frame 2, on which the sewing object C is arranged, in the state in which the second member 8 is disposed in the second position with respect to the first member 4, the ratio of the part of the inner frame 3 disposed facing the outer frame 2 with respect to the inner periphery 26 of the outer frame 2 is large, in comparison to the embroidery frame 1 in which the shaft distance D is equal to or more than twice the thickness T3 of the outer frame 2. Particularly, of the left-side portion 37 and the right-side portion 38 of the inner frame 3 on which the rotating shafts 9 are respectively provided, the ratio of the part that is disposed facing the outer frame 2 is large. In comparison to the embroidery frame 1 in which the shaft distance D is equal to or more than twice the thickness T3 of the outer frame 2, in the embroidery frame 1, of the part of the sewing object C that is in contact with the outer frame 2, the ratio of the part which is clamped between the outer frame 2 and the inner frame 3 and whose arrangement with respect to the outer frame 2 is provisionally determined is large, and the arrangement of the sewing object C with respect to the outer frame 2 is provisionally determined in a secure manner. Therefore, in comparison to the embroidery frame 1 in which the shaft distance D is equal to or more than twice the thickness T3 of the outer frame 2, in the embroidery frame 1, in the course of causing the transition from the state in which the second member 8 is disposed in the second position with respect to the first member 4 to the state in which the second member is disposed in the first position, the arrangement of the sewing object C with respect to the outer frame 2 is unlikely to be displaced, and the sewing object C is easily and appropriately held on the embroidery frame 1.

As shown in FIG. 6B, the first position is the position at which the angle of the second member 8 with respect to the first member 4 is the holding angle K1 that is larger than 180 degrees on the one side in the circumferential direction. The absolute value of the difference between the holding angle K1 and 180 degrees is smaller than the absolute value of the difference between the contact angle K2 and 180 degrees. The inner frame 3 is provided with the restriction members 6 that restrict the second member 8 from rotating from the first position to the one side in the circumferential direction with respect to the first member 4. Therefore, in the embroidery frame 1, when the second member 8 is disposed in the first position with respect to the first member 4, the angle of the second member 8 with respect to the first member 4 is the holding angle K that is larger than 180 degrees on the one side in the circumferential direction. In the state in which the second member 8 is disposed in the first position with respect to the first member 4, the inner periphery 26 of the outer frame 2 and the outer periphery 30 of the inner frame 3 have substantially the same shape, and in the state in which the sewing object C is arranged between the outer frame 2 and the inner frame 3, the inner frame 3 receives, from the outer frame 2, a clamping force toward the inner side of the inner frame 3. The embroidery frame 1 is provided with the lock mechanisms 5 that restrict the second member 8 from rotating from the first position with respect to the first member 4 when the second member 8 is in the first position with respect to the first member 4. Therefore, the clamping force applied to the inner frame 3 by the outer frame 2 acts to continue to hold the second member 8 in the first position with respect to the first member 4. For that reason, in order to move the second member 8 from the state in which the second member 8 is disposed in the first position with respect to the first member 4 to the state in which the second member 8 is disposed in the second position, it is necessary that a force toward the outer side of the inner frame 3 that exceeds the clamping force acting on the inner frame 3 from the outer frame 2 be applied to the inner frame 3. More specifically, in the state in which the second member 8 is disposed in the first position with respect to the first member 4, when the inner frame 3 is disposed on the inner side of the outer frame 2, the embroidery frame 1 forms a toggle structure as the whole of the embroidery frame 1, and the second member 8 is held in the first position with respect to the first member 4 due to an effect of the toggle structure. Thus, in comparison to when the first position is a position at which the angle of the second member 8 with respect to the first member 4 is equal to or less than 180 degrees on the one side in the circumferential direction, in the embroidery frame 1, due to the effect of the toggle structure, it is unlikely that the second member 8 is unintentionally moved from the state in which the second member 8 is disposed in the first position with respect to the first member 4 to the state in which the second member 8 is disposed in the second position, and it is easy to stably maintain the state in which the second member 8 is disposed in the first position with respect to the first member 4.

The embroidery frame 1 is provided with the lock mechanisms 5 that restrict the second member 8 from rotating from the first position with respect to the first member 4 when the second member 8 is in the first position with respect to the first member 4. Therefore, by using the lock mechanisms 5, the embroidery frame 1 can reliably avoid the rotation of the second member 8 from the first position with respect to the first member 4. In comparison to when the embroidery frame 1 is not provided with the lock mechanisms 5, the second member 8 can be easily maintained in the first position with respect to the first member 4.

The lock mechanism 5 is provided with the lock engaging portion 51, the lock urging member 52, and the lock engaged portion 80. The lock engaging portion 51 is movably provided on one selected from the group of the first member 4 and the second member 8. The lock urging member 52 is provided on the one selected from the group of the first member 4 and the second member 8, and urges the lock engaging portion 51 in the direction intersecting the plane that forms the outer periphery 30 of the inner frame 3. The lock engaged portion 80 is provided on the other selected from the group of the first member 4 and the second member 8. When the second member 8 is rotated to the first position with respect to the first member 4, the lock engaged portion 80 engages with the lock engaging portion 51 that is moved by the urging force of the lock urging member 52. Thus, in the embroidery frame 1, the lock mechanism 5 can have a relatively simple structure.

The inner frame 3 of the embroidery frame 1 is provided with the lock release members 7, each of which can move the lock engaging portion 51 against the urging force of the lock urging member 52 and can thus release the engagement between the lock engaging portion 51 and the lock engaged portion 80. In comparison to when the embroidery frame 1 is not provided with the lock release members 7, the engagement between the lock engaging portion 51 and the lock engaged portion 80 can be easily released. Since the lock release member 7 of the present embodiment is a member integrated with the lock engaging portion 51, the structure thereof is simpler than when they are separate bodies.

The rotating shaft 9 is positioned on the side that is further separated from the virtual plane V in the thickness direction of the first member 4 than the center M3 of the first member 4 in the thickness direction. The virtual plane V is in contact with the first end portion 46 and the second end portion 86 and is parallel to the rotating shaft 9. Thus, in the embroidery frame 1, a difference between the first distance L1 and the second distance L2 can be made larger than when the rotating shaft 9 is disposed on a side closer to the virtual plane V than the center M3 of the first member 4 in the thickness direction.

When the second member 8 is in the first position with respect to the first member 4, the first member 4 and the second member 8 of the inner frame 3 form a rectangular frame shape along the inner periphery 26 of the outer frame 2. In the two side portions 37 and 38 of the inner frame 3 that face each other, the rotating shafts 9 are respectively located at positions that are separated from the center M2 of the two side portions 37 and 38. In comparison to when the rotating shafts 9 are respectively located at the center M2 of the two side portions 37 and 38 of the inner frame 3, in the embroidery frame 1, it is possible to improve design freedom of the structure to rotatably couple the second member 8 to the first member 4. Given a condition in which the distance from the virtual plane V to the rotating shaft 9 in the second position is not changed, the more the rotating shaft 9 is separated from the center M2, the larger the difference between the first distance L1 and the second distance L2 can be made. Given a condition in which the second distance L2 is not changed, the more the rotating shaft 9 is separated from the center M2, the shorter the shaft distance D can be made. Further, in the embroidery frame 1 of the present embodiment, the rotating shaft 53 of the lock release member 7 can be disposed in the vicinity of the center M2 in the front-rear direction, and an operation by the user is easy in comparison to when the rotating shaft 53 is disposed at a corner portion of the embroidery frame 1.

The inner frame 3 is provided with the urging members 10 that urge the second member 8 to the other side in the circumferential direction with respect to the first member 4. Thus, it is possible to avoid the movement of the second member 8 from the second position to the first position with respect to the first member 4 when the user does not intend to move the second member 8.

The method for causing the sewing object C to be held on the embroidery frame 1 includes the sewing object arrangement process (step S1), the inner frame arrangement process (step S2), and the holding process (step S3). According to the method for causing the sewing object C to be held on the embroidery frame 1, the user can cause the sewing object C to be held by the outer frame 2 and the inner frame 3, by performing a simple operation of pressing the inner frame 3 to the sewing object C side after determining the position of the sewing object C with respect to the outer frame 2.

In the method for causing the sewing object C to be held on the embroidery frame 1, the first position is the position at which the angle of the second member 8 with respect to the first member 4 is the holding angle K1 that is larger than 180 degrees on the one side in the circumferential direction. The absolute value of the difference between the holding angle K1 and 180 degrees is smaller than the absolute value of the difference between the contact angle K2 and 180 degrees. In comparison to when the first position is a position at which the angle of the second member 8 with respect to the first member 4 is equal to or less than 180 degrees on the one side in the circumferential direction, in the embroidery frame 1, it is unlikely that the second member 8 is unintentionally moved from the state in which the second member 8 is disposed in the first position with respect to the first member 4 to the state in which the second member 8 is disposed in the second position, and it is easy to maintain the state in which the second member 8 is disposed in the first position with respect to the first member 4.

In the holding process, when the second member 8 is in the first position with respect to the first member 4, the restriction member 6 restricts the second member 8 from rotating further to the one side in the circumferential direction than the first position with respect to the first member 4. By using the lock mechanism 5, the embroidery frame 1 can reliably avoid the rotation of the second member 8 from the first position with respect to the first member 4. In comparison to when the embroidery frame 1 is not provided with the lock mechanism 5, it is easy to maintain the state in which the second member 8 is disposed in the first position with respect to the first member 4.

An embroidery frame of the present disclosure, a method for causing a sewing object to be held on an embroidery frame, and an inner frame of an embroidery frame are not limited to the above-described embodiment, and various changes may be added without departing from the spirit and scope of the present disclosure. For example, the following modifications may be added as appropriate.

(A) The structures of the embroidery frame and the inner frame of the embroidery frame may be changed as appropriate. The embroidery frame 1 may be an embroidery frame that can be attached to various sewing machines having an embroidery function, or may be an embroidery frame that cannot be attached to the sewing machine. When the embroidery frame 1 can be attached to the sewing machine, the coupling portions 27 and 28 to attach the embroidery frame 1 to the sewing machine may be fixed to the inner frame 3. It is sufficient that, in order to attach the embroidery frame 1 to the sewing machine, one or more coupling portions be provided on the outer frame 2 or the inner frame 3 of the embroidery frame 1. The shape, the size, and the like of the embroidery frame 1 may be changed as appropriate, and for example, the embroidery frame 1 may have an annular shape or a polygonal shape.

Figure 8:
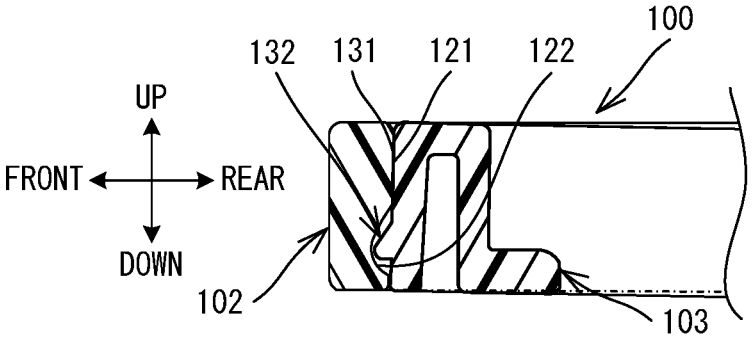
FIG. 8 is a cross-sectional view of an embroidery frame of a modified example.

(B) The shape of the inner periphery 26 of the outer frame 2, and the shape of the outer periphery 30 of the inner frame 3 may be changed as appropriate. Although not shown in the drawings, in embroidery frames 100, 200 and 300 of the following modified examples, structures other than the shape of the inner periphery 26 of the outer frame 2 and the shape of the outer periphery 30 of the inner frame 3 are the same as those of the embroidery frame 1. As shown in FIG. 8, the embroidery frame 100 of a modified example is provided with an outer frame 102 and an inner frame 103. An inner periphery 121 of the outer frame 102 is provided with an outer frame engagement portion 122. The outer frame engagement portion 122 is a recessed portion that is recessed toward the outer side of the outer frame 102, and is provided lower than the center of the inner periphery 121 in the up-down direction. The outer frame engagement portion 122 may be formed along the entire periphery of the inner periphery 121 of the of the outer frame 102, or may be formed along a part of the inner periphery 121. An outer periphery 131 of the inner frame 103 is provided with an inner frame engagement portion 132 that engages with the outer frame engagement portion 122 when the second member is in the first position with respect to the first member. The inner frame engagement portion 132 is a protruding portion that protrudes to the outer side of the inner frame 103, and is provided on the outer periphery 131 of the inner frame 103. When the inner frame engagement portion 132 and the outer frame engagement portion 122 are engaged with each other, it is easy to maintain the state in which the second member is in the first position with respect to the first member.

Figure 9:
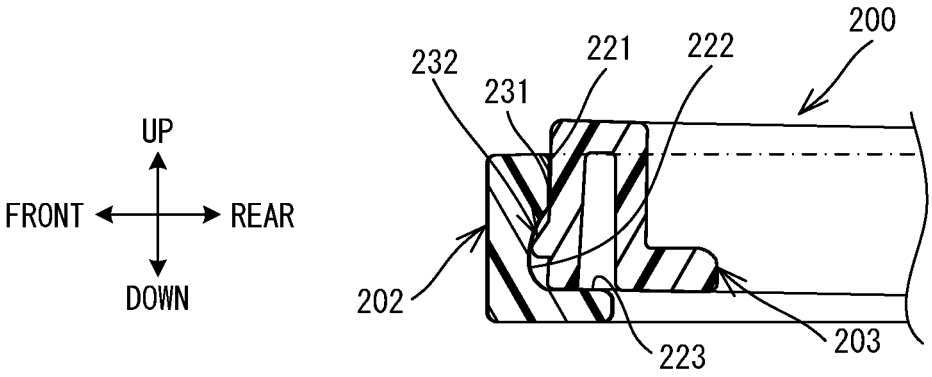
FIG. 9 is a cross-sectional view of an embroidery frame of a modified example.
Figure 10:
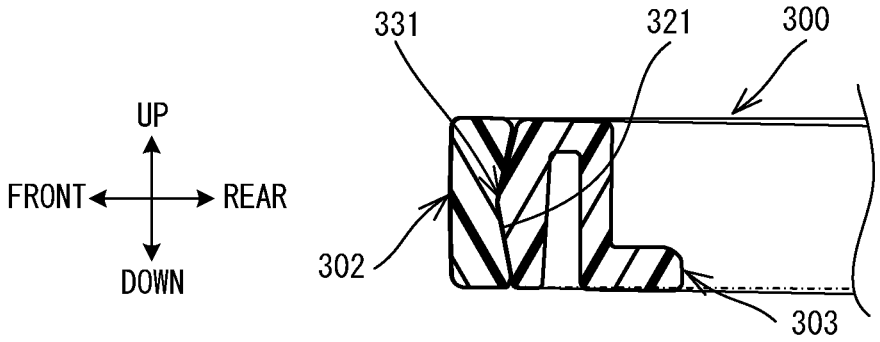
FIG. 10 is a cross-sectional view of an embroidery frame of a modified example.

In a similar manner to the embroidery frame 100 of the modified example, as shown in FIG. 9, the embroidery frame 200 of a modified example is provided with an outer frame 202 and an inner frame 203. The outer frame 202 is provided with an outer frame engagement portion 222 provided in an inner periphery 221, and a rib 223 that protrudes from a lower portion of the inner periphery 221 to the inner side of the outer frame 202. An outer periphery 231 of the inner frame 203 is provided with an inner frame engagement portion 232 that engages with the outer frame engagement portion 222 when the second member is in the first position with respect to the first member. When the inner frame 203 is attached to the outer frame 202, the inner frame engagement portion 232 engages with the outer frame engagement portion 222, and the lower surface of the inner frame 203 is disposed on the upper surface of the rib 223. As shown in FIG. 10, the embroidery frame 300 is provided with an outer frame 302 and an inner frame 303. The outer frame 302 is provided with an inner periphery 321 that is recessed to the outer side of the outer frame 302. The inner frame 303 is provided with an outer periphery 331 that engages with the inner periphery 321 when the second member is in the first position with respect to the first member. The outer periphery 331 has a shape that protrudes to the outer side of the inner frame 303. In comparison to the embroidery frame 1 that does not include an outer frame engagement portion and an inner frame engagement portion, the above-described embroidery frames 100, 200 and 300 can stably hold the sewing object C, respectively, using the inner frames 103, 203 and 303, and the outer frames 102, 202 and 302. The shapes and the arrangement of the outer frame engagement portion and the inner frame engagement portion may be changed as appropriate.

The first position, the second position, the first distance L1, the second distance L2, the shaft distance D, the holding angle K1, and the contact angle K2 may be changed as appropriate. The first position may be a position at which the angle of the second member 8 with respect to the first member 4 is equal to or less than 180 degrees on the one side in the circumferential direction around the rotating shaft 9. With respect to the first member, the contact angle may be an angle that is less than 90 degrees or equal to or more than 180 degrees on the one side in the circumferential direction. With respect to the first member, the holding angle may be an angle that is equal to or more than 90 degrees and equal to or less than 180 degrees on the one side in the circumferential direction. The second distance L2 may be less than 75 percent of the first distance L1. When the second member 8 is in the second position with respect to the first member 4, the shaft distance D may be twice or more of the thickness T3 of the outer frame 2. The absolute value of the difference between the holding angle K1 and 180 degrees may be equal to or more than the absolute value of the difference between the contact angle K2 and 180 degrees. The rotating shaft 9 may be positioned at the center M3 of the first member 4 in the thickness direction, or on a side closer to the virtual plane V than the center M3.

At least one selected from the group of the restriction member 6, the lock mechanism 5, the lock release member 7 and the urging member 10 may be omitted from the inner frame 3. In the inner frame 3, the structure, the number, the arrangement and the like of the restriction member 6, the lock mechanism 5, the lock release member 7 and the urging member 10 may be changed as appropriate. For example, in the inner frame 3, only the left-side portion 37 of the inner frame 3 may be provided with the restriction member 6, the lock mechanism 5, the lock release member 7 and the urging member 10, and at least some of the members of the right-side portion 38 may be omitted. The arrangement of the rotating shafts 9 may be changed as appropriate. The structures of the lock urging member 52 and the urging member 10 may be changed as appropriate, and, for example, a plate spring or the like may be used. The lock engaging portion 51 and the lock release member 7 may be separate bodies. The rotating shafts 9 may be respectively provided at central portions in the extending direction of the two side portions 37 and 38 of the inner frame 3 that face each other. The rotating shafts 9 may be disposed on side portions of the embroidery frame 1 that are not provided with the coupling portions 27 and 28. The length of the first member 4 in the front-rear direction may be the same as the length of the second member 8 in the front-rear direction, or may be longer than the length of the second member 8 in the front-rear direction. The rotating shafts 9 may be provided at a central portion of the inner frame 3 in the thickness direction. The lock engaging portion 51 and the lock urging member 52 may be provided on the second member 8, and the lock engaged portion 80 may be provided on the first member 4. The rotating shafts 9 may be formed integrally with the first member 4 or the second member 8.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. An embroidery frame comprising:

an outer frame; and an inner frame configured to hold a sewing object together with the outer frame, the inner frame including a first member provided with a restriction portion, and a second member configured to be rotatably supported around a rotating shaft between a first position and a second position with respect to the first member, the first member and the second member of the inner frame forming a shape that extends along an inner periphery of the outer frame when the second member is in the first position with respect to the first member, the second position being a position at which an angle of the second member with respect to the first member is a contact angle larger than 0 degrees and less than 180 degrees in a first direction along a circumferential direction of the rotating shaft from the first member to the second member, the second member including a contact portion which comes into contact with the restriction portion when the second member is in the second position with respect to the first member and which restricts the second member from rotating further along a second direction along the circumferential direction than the second position with respect to the first member, the second direction being opposite to the first direction, a first distance between a first end portion and a second end portion when the second member is in the first position with respect to the first member being longer than a second distance between the first end portion and the second end portion when the second member is in the second position with respect to the first member, the first end portion being a farthest section of the first member from the rotating shaft in a radius direction orthogonal to the rotating shaft, and the second end portion being a farthest section of the second member from the rotating shaft in the radius direction, the contact angle facing a virtual plane, the virtual plane being in contact with the first end portion and the second end portion when the second member is in the second position with respect to the first member, and being parallel to the rotating shaft.

2. The embroidery frame according to claim 1, wherein the contact angle is an angle equal to or more than 90 degrees and less than 180 degrees in the first direction along the circumferential direction.

3. The embroidery frame according to claim 1, wherein the second distance between the first end portion and the second end portion when the second member is in the second position with respect to the first member is equal to or more than 75 percent and less than 100 percent of the first distance between the first end portion and the second end portion when the second member is in the first position with respect to the first member.

4. The embroidery frame according to claim 1, wherein when the second member is in the second position, a shaft distance from the virtual plane to the rotating shaft is shorter than twice a thickness of the outer frame.

5. The embroidery frame according to claim 1, wherein the first position is a position at which the angle of the second member with respect to the first member is a holding angle larger than 180 degrees in the first direction along the circumferential direction, an absolute value of a difference between the holding angle and 180 degrees is smaller than an absolute value of a difference between the contact angle and 180 degrees, and the inner frame includes a restriction member having a plate portion, when the second member is in the first position with respect to the first member, contacting with the second member to restrict the second member from rotating from the first position in the first direction along the circumferential direction with respect to the first member.

6. The embroidery frame according to claim 1, further comprising:

a lock mechanism contacting with the first member and the second member to restrict the second member from rotating from the first position with respect to the first member when the second member is in the first position with respect to the first member.

7. The embroidery frame according to claim 6, wherein the lock mechanism includes a lock engaging portion movably provided on one member selected from a group of the first member and the second member, a lock urging member provided on the one member selected from the group of the first member and the second member, the lock urging member being a spring configured to urge the lock engaging portion in a direction intersecting a surface forming an outer periphery of the inner frame, and a lock engaged portion provided on another member selected from the group of the first member and the second member, the lock engaged portion engaging with the lock engaging portion moved by an urging force of the lock urging member when the second member is rotated to the first position with respect to the first member.

8. The embroidery frame according to claim 7, further comprising:

a lock release member configured to move the lock engaging portion against the urging force of the lock urging member and to release the engagement between the lock engaging portion and the lock engaged portion.

9. The embroidery frame according to claim 1, wherein when the second member is in the second position with respect to the first member, the rotating shaft is positioned further separated from the virtual plane in a thickness direction of the first member than a center in the thickness direction of the first member.

10. The embroidery frame according to claim 1, wherein the first member and the second member of the inner frame form a rectangular shape along the inner periphery of the outer frame when the second member is in the first position with respect to the first member, and the rotating shaft is in a position separated from a center of each of two side portions of the inner frame, the two side portions facing each other.

11. The embroidery frame according to claim 1, wherein the inner periphery of the outer frame includes an outer frame engagement portion, and an outer periphery of the inner frame includes an inner frame engagement portion that extends along the outer frame engagement portion to engage with the outer frame engagement portion when the second member is in the first position with respect to the first member.

12. The embroidery frame according to claim 1, further comprising:

an urging member being a spring configured to urge the second member in the second direction along the circumferential direction with respect to the first member.

13. A method for causing a sewing object to be held on an embroidery frame, the method comprising:

a sewing object arrangement process of arranging the sewing object on an outer frame;

an inner frame arrangement process of arranging, on an inner side of an inner periphery of the outer frame on which the sewing object is arranged, an inner frame which includes a first member and a second member configured to be rotatably supported around a rotating shaft between a first position and a second position with respect to the first member and in which the first member and the second member form a shape that extends along the inner periphery of the outer frame, when the second member is in the second position at which an angle of the second member with respect to the first member is a contact angle larger than 0 degrees and smaller than 180 degrees in a first direction along a circumferential direction of the rotating shaft from the first member to the second member, and of causing a first end portion of the first member and a second end portion of the second member to come into contact with the sewing object arranged on the outer frame, the first end portion being most separated from the rotating shaft in a radius direction orthogonal to the rotating shaft, and the second end portion being most separated from the rotating shaft in the radius direction, the contact angle facing a virtual plane, the virtual plane being in contact with the first end portion and the second end portion when the second member is in the second position with respect to the first member, and being parallel to the rotating shaft; and a holding process of causing the sewing object to be held by the outer frame and the inner frame, the holding process including moving the second member to the first position with respect to the first member by pressing the inner frame arranged in the inner frame arrangement process toward the sewing object to widen a distance between the first end portion and the second end portion in comparison to when the second member is in the second position with respect to the first member.

14. The method for causing the sewing object to be held on the embroidery frame according to claim 13, wherein the first position is a position at which the angle of the second member with respect to the first member is a holding angle larger than 180 degrees along the first direction along the circumferential direction, and an absolute value of a difference between the holding angle and 180 degrees is smaller than an absolute value of a difference between the contact angle and 180 degrees.

15. The method for causing the sewing object to be held on the embroidery frame according to claim 13, wherein in the holding process, when the second member is in the first position with respect to the first member, the second member is restricted from rotating further in the first direction along the circumferential direction than the first position with respect to the first member.

16. An inner frame of an embroidery frame comprising:

a first member provided with a restriction portion, and a second member configured to be rotatably supported around a rotating shaft between a first position and a second position with respect to the first member, the first member and the second member of the inner frame forming a shape that extends along an inner periphery of an outer frame when the second member is in the first position with respect to the first member, the second position being a position at which an angle of the second member with respect to the first member is a contact angle larger than 0 degrees and less than 180 degrees in a first direction along a circumferential direction of the rotating shaft from the first member to the second member, the second member including a contact portion which comes into contact with the restriction portion when the second member is in the second position with respect to the first member and which restricts the second member from rotating further along a second direction along the circumferential direction than the second position with respect to the first member, the second direction being opposite to the first direction, a first distance between a first end portion and a second end portion when the second member is in the first position with respect to the first member being longer than a second distance between the first end portion and the second end portion when the second member is in the second position with respect to the first member, the first end portion being a farthest section of the first member from the rotating shaft in a radius direction orthogonal to the rotating shaft, and the second end portion being a farthest section of the second member from the rotating shaft in the radius direction, the contact angle facing a virtual plane, the virtual plane being in contact with the first end portion and the second end portion when the second member is in the second position with respect to the first member, and being parallel to the rotating shaft.

* * * * *